US007607191B2

(12) United States Patent
Morris et al.

(10) Patent No.: US 7,607,191 B2
(45) Date of Patent: Oct. 27, 2009

(54) ADJUSTABLE-SIZE MOP HEAD AND SELECTABLE-SIZE CLEANING SUBSTRATE

(75) Inventors: Cameron Ray Morris, Cumming, GA (US); Stephanie Ann Rossignol, Cumming, GA (US); George Nukuto, Neenah, WI (US); Denis R. Grimard, Appleton, WI (US); Carl G. Rippl, Appleton, WI (US); MeeWha Lee, Appleton, WI (US); Paul Woon, Alpharetta, GA (US); Russell J. Kroll, Atlanta, GA (US); Mark Londborg, Atlanta, GA (US); Robert Henshaw, Newnan, GA (US); Kiran K. Reddy, Roswell, GA (US); Thomas Glenn Merrill, Cumming, GA (US); Jose Ricardo Rubio-Flores, Jr., Roswell, GA (US); Dennis Y. Lee, Cumming, GA (US); Nathan P. Hendon, Marietta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 5 days.

(21) Appl. No.: 11/458,109

(22) Filed: Jul. 18, 2006

(65) Prior Publication Data

US 2008/0016639 A1 Jan. 24, 2008

(51) Int. Cl.
*A47L 13/10* (2006.01)

(52) U.S. Cl. ..... 15/228; 15/229.6; 15/147.1; 15/149

(58) Field of Classification Search ..... 15/228, 15/229.1–229.9, 147.1, 147.2, 149
See application file for complete search history.

(56) References Cited

U.S. PATENT DOCUMENTS 1,605,008 A 11/1926 Smith (Continued)

FOREIGN PATENT DOCUMENTS

DE 3738408 A1 5/1989

(Continued)

OTHER PUBLICATIONS

Patent Abstracts of Japan, JP 08228985 A, Sep. 10, 1996.
Patent Abstracts of Japan, JP 10276953 A, Oct. 20, 1998.
Patent Abstracts of Japan, JP 2001309881 A, Nov. 6, 2001.
Patent Abstracts of Japan, JP 2002102132A, Apr. 9, 2002.

(Continued)

*Primary Examiner*—Shay L Karls
(74) *Attorney, Agent, or Firm*—Nathan P. Hendon

(57) ABSTRACT

An adjustable-size mop head assembly that may be used with a handle and a disposable cleaning substrate is disclosed. The mop head assembly includes a central frame section with a central portion and a lower substrate support surface configured to hold a disposable cleaning substrate. The mop head assembly also includes at least one adjunct frame section configured to be operably coupled to the central frame section and configured to move between a stored configuration, where the adjunct frame section is stored by the central frame section, and an extended configuration where the adjunct frame section extends from the central frame section to add width to the central frame section and the lower substrate support surfaces. A continuous web of disposable cleaning substrate that may be used with the adjustable-size mop head assembly is also disclosed. The continuous web of disposable cleaning substrate includes lines of weakness at regular intervals configured such that various widths of cleaning substrate are removable via the lines of weakness.

8 Claims, 7 Drawing Sheets

U.S. PATENT DOCUMENTS 2,328,287 A 8/1943 Martin
2,900,652 A 8/1959 Kautenberg
3,208,318 A 9/1965 Roberts
3,221,356 A 12/1965 Schimer
3,395,415 A 8/1968 Leland
3,605,161 A 9/1971 Moss et al.
3,692,618 A 9/1972 Dorschner et al.
3,737,938 A 6/1973 Saltzstein
3,778,860 A 12/1973 Thielen
3,792,505 A 2/1974 Saltzstein
3,837,031 A 9/1974 Allaire et al.
3,849,241 A 11/1974 Butin et al.
3,850,533 A 11/1974 Thielen
4,041,203 A 8/1977 Brock et al.
4,114,223 A 9/1978 Buchanan
4,225,998 A 10/1980 Thielen
4,247,216 A 1/1981 Pansini
4,340,563 A 7/1982 Appel et al.
4,353,142 A 10/1982 Nishiyama et al.
4,433,931 A 2/1984 Malish et al.
4,685,167 A 8/1987 Murray
4,763,377 A 8/1988 Madsen
4,766,632 A * 8/1988 Murray ..... 15/147.1
4,819,293 A 4/1989 Nicholson
4,845,800 A * 7/1989 Pederson et al. ..... 15/228
4,852,210 A 8/1989 Krajicek
4,962,682 A 10/1990 Rose et al.
5,071,489 A 12/1991 Silvenis et al.
5,145,727 A 9/1992 Potts et al.
5,169,706 A 12/1992 Collier, IV et al.
5,178,931 A 1/1993 Perkins et al.
5,188,885 A 2/1993 Timmons et al.
5,207,754 A 5/1993 Harrah
5,253,387 A 10/1993 Kresse et al.
5,288,161 A 2/1994 Graves et al.
D348,827 S 7/1994 Berti et al.
5,343,587 A 9/1994 Findley
5,375,286 A 12/1994 Harrah
5,379,478 A 1/1995 Vosbikian
5,394,594 A 3/1995 Duran
5,402,559 A 4/1995 Allison et al.
5,419,015 A 5/1995 Garcia
5,442,830 A 8/1995 Ohm
5,455,980 A 10/1995 Buchanan
5,461,749 A 10/1995 Ahlberg et al.
D366,740 S 1/1996 Clausen et al.
5,522,648 A 6/1996 Wilen
5,581,839 A 12/1996 Ferrell, Jr.
5,701,628 A 12/1997 Morad
5,740,578 A 4/1998 Moore
D398,724 S 9/1998 Kohlruss et al.
5,842,810 A 12/1998 Morad
5,876,141 A 3/1999 Hsu
5,901,402 A 5/1999 Williams
5,911,258 A 6/1999 Morad
5,920,944 A 7/1999 Biggs et al.
5,937,471 A 8/1999 Liao
6,023,812 A 2/2000 Morad
6,061,864 A 5/2000 Ensson
6,119,298 A 9/2000 Kenmochi
6,212,917 B1 4/2001 Rathbun
6,237,182 B1 5/2001 Cassar
6,298,517 B1 10/2001 McKay
6,305,046 B1 10/2001 Kingry et al.
6,354,666 B1 3/2002 Atkins et al.
D458,722 S 6/2002 Romero et al.
6,405,403 B1 6/2002 McKay
D461,028 S 7/2002 Ng
D461,029 S 7/2002 Ng
D464,181 S 10/2002 Ng
D465,890 S 11/2002 Rivera et al.
6,484,346 B2 11/2002 Kingry et al.
6,513,199 B1 2/2003 Cheng
6,654,980 B2 12/2003 Biggs
6,684,446 B2 2/2004 Salmon
6,736,034 B1 5/2004 Gonzales
6,804,853 B2 * 10/2004 Wang ..... 15/172
6,810,554 B2 11/2004 McKay
6,820,301 B2 11/2004 Petner
6,842,936 B2 1/2005 Policicchio et al.
6,854,919 B2 2/2005 Neumann et al.
6,871,372 B2 3/2005 Vosbikian et al.
6,889,917 B2 5/2005 Fahy et al.
6,925,686 B2 8/2005 Heathcock et al.
6,953,299 B2 10/2005 Wang et al.
6,976,282 B2 12/2005 Sie
6,986,618 B2 1/2006 Hall et al.
7,065,825 B2 6/2006 Minkler et al.
2001/0009632 A1 7/2001 Cross
2003/0009839 A1 1/2003 Streutker et al.
2003/0028988 A1 2/2003 Streutker et al.
2003/0084531 A1 5/2003 Dingert et al.
2003/0110584 A1 * 6/2003 Clare et al. ..... 15/104.94
2003/0221274 A1 12/2003 Makhija et al.
2004/0068817 A1 4/2004 Policicchio
2004/0074520 A1 4/2004 Truong et al.
2004/0088808 A1 5/2004 Vitantonio et al.
2004/0163194 A1 8/2004 Wang
2004/0182952 A1 9/2004 Soller et al.
2004/0188539 A1 9/2004 Soller et al.
2004/0244131 A1 12/2004 Cassar
2004/0244133 A1 12/2004 Li
2004/0255418 A1 12/2004 Minkler et al.
2005/0011536 A1 1/2005 Hofte et al.
2005/0060827 A1 3/2005 James et al.
2005/0066465 A1 3/2005 Minkler et al.
2005/0091775 A1 5/2005 Linkholm
2005/0097691 A1 5/2005 Tsuchiya et al.
2005/0102781 A1 5/2005 Tsuchiya et al.
2005/0251941 A1 11/2005 Berhoff
2005/0251943 A1 11/2005 VanLandingham, Jr.
2005/0265769 A1 12/2005 Blom
2005/0283933 A1 12/2005 Mitchell et al.
2005/0285387 A1 12/2005 Suda et al.
2006/0000041 A1 1/2006 Streutker et al.
2006/0048327 A1 3/2006 Lacotta et al.
2006/0075587 A1 4/2006 Broman
2006/0191557 A1 8/2006 Rosenzweig et al.

FOREIGN PATENT DOCUMENTS

DE 19908259 A1 8/2000
DE 10003899 9/2001
EP 0697269 A2 2/1996
EP 0980667 A2 2/2000
EP 0811350 B1 11/2000
EP 0966222 B1 9/2003
EP 1591053 A1 11/2005
GB 2259474 3/1993
WO WO 88/01845 3/1988
WO WO 99/60913 12/1999
WO WO 03/039321 5/2003
WO WO 2004/071266 8/2004
WO WO 05/074781 8/2005
WO WO 2005/084516 9/2005
WO WO 2006/002653 1/2006

OTHER PUBLICATIONS

Lawrence, K.D. et al., "An Improved Device for the Formation of Super-Fine Thermoplastic Fibers," NRL Report 5265, Feb. 11, 1959.
Wendt, B.A. et al., "Manufacture of Superfine Organic Fibers", NRL Report 4364, May 25, 1954.

* cited by examiner

ADJUSTABLE-SIZE MOP HEAD AND SELECTABLE-SIZE CLEANING SUBSTRATE

BACKGROUND

Various versions of floor mops are commonly available for the variety of cleaning needs in both commercial and domestic consumer environments. For example, cotton string floor dust mops are commonly seen cleaning the dust and debris from school and public building hallways. One problem with such cotton string dust mops is that the dirt and debris can build up in the cotton substrate. Such mop heads need to be regularly cleaned or replaced. Cleaning or replacing the substrate can be cumbersome and may result in significant added cost to the user.

In response to the problems of such cotton string mops, various dust mops are readily available for commercial and consumer home use that utilize disposable cleaning substrates applied to the mop head. The disposable cleaning substrate is most commonly wrapped across the floor-contacting surface of such mop heads and both of the substrate's free ends are clamped, grasped or otherwise attached to the upper surface of the mop head. Such disposable substrates also need to be regularly replaced as the substrate become soiled in use, however the substrate is easier to replace than the cotton string substrate of commercial dust mops. The use of disposable cleaning substrates also allows the user to utilize different types of cleaning substrate materials, wet substrates, substrates incorporating cleaning solutions, and the like. All such various types of disposable substrates may be configured for use with a single mop head.

However, one inconvenience experienced by users is the collection of mops that is required to meet the varied cleaning needs the user encounters. To meet the various cleaning needs of the users, commercial and domestic dust mops are available with mop heads varying from about 6 inches (152 mm) to about 48 inches (1.2 m) in width, and all widths within such range. Generally, each dust mop head is fitted with its own handle. A user with a collection of various mop widths will often have a closet, cabinet, maintenance cart or wall rack cluttered with a collection of such mops and their associated handles.

Another issue with the collection of mop heads of various widths is the disposable cleaning substrate. Typically, the disposable cleaning substrates used with such mops are delivered to the user in a sheet format; each sheet cut to the dimensions required for a single, specific mop head. Thus, each mop head width will require its own supply of disposable cleaning substrate made specific for the particular head width. The collection of disposable cleaning substrates becomes magnified if different types of cleaning substrates are also desired for each particular mop head width.

DEFINITIONS

As used herein, the term "fasteners" means devices that fasten, join, connect, secure, hold, or clamp components together. Fasteners include, but are not limited to, screws, nuts and bolts, rivets, snap-fits, tacks, nails, loop fasteners, and interlocking male/female connectors, such as fishhook connectors, a fish hook connector includes a male portion with a protrusion on its circumference. Inserting the male portion into the female portion substantially permanently locks the two portions together.

As used herein, the term "couple" includes, but is not limited to, joining, connecting, fastening, linking, or associating two things integrally or interstitially together.

As used herein, the term "configure(s)", "configured" or "configuration(s)" means to design, arrange, set up, or shape with a view to specific applications or uses. For example: a military vehicle that was configured for rough terrain; configured the computer by setting the system's parameters.

As used here, the term "operable" or "operably" means being in a configuration such that use or operation is possible. Similarly, "operably connect(s)" or "operably connected" refers to the relation of elements being so configured that a use or an operation is possible through their cooperation. For example: the machine is operable; the wheel is operably connected to the axle.

As used herein, the term "hinge" refers to a jointed or flexible device that connects and permits pivoting or turning of a part to a stationary component. Hinges include, but are not limited to, metal pivotable connectors, such as those used to fasten a door to frame, and living hinges. Living hinges may be constructed from plastic and formed integrally between two members. A living hinge permits pivotable movement of one member in relation to another connected member.

As used herein, the term "substantially" refers to something which is done to a great extent or degree; for example, "substantially covered" means that a thing is at least 95% covered.

As used herein, the term "alignment" refers to the spatial property possessed by an arrangement or position of things in a straight line or in parallel lines.

As user herein, the terms "orientation" or "position" used interchangeably herein refer to the spatial property of a place where or way in which something is situated; for example, "the position of the hands on the clock."

As used herein the terms "nonwoven fabric", "nonwoven material", or "nonwoven web" means a web having a structure of individual fibers or threads which are interlaid, but not in an identifiable manner as in a knitted fabric. Nonwoven fabrics or webs have been formed from many processes such as for example, meltblowing processes, spunbonding processes, and bonded carded web processes. The basis weight of nonwoven fabrics is usually expressed in ounces of material per square yard (osy) or grams per square meter ($g/m^2$ or gsm) and the fiber diameters useful are usually expressed in microns. (Note that to convert from osy to gsm, multiply osy by 33.91).

As used herein, the term "spunbond", "spunbonded", and "spunbonded filaments" refers to small diameter continuous filaments which are formed by extruding a molten thermoplastic material as filaments from a plurality of fine, usually circular, capillaries of a spinnerette with the diameter of the extruded filaments then being rapidly reduced as by, for example, eductive drawing and/or other well-known spunbonding mechanisms. The production of spunbonded nonwoven webs is illustrated in patents such as, for example, in U.S. Pat. No. 4,340,563 to Appel et al., and U.S. Pat. No. 3,692,618 to Dorschner et al. The disclosures of these patents are hereby incorporated by reference.

As used herein the term "meltblown" means fibers formed by extruding a molten thermoplastic material through a plurality of fine, usually circular die capillaries as molten threads or filaments into converging high velocity gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed, in various patents and publications, including NRL Report 4364, "Manufacture of Super-Fine Organic Fibers" by B. A. Wendt, E. L. Boone and D. D. Fluharty; NRL Report 5265, "An Improved Device For The Formation of Super-Fine Thermoplastic Fibers" by K. D. Lawrence, R. T. Lukas, J. A. Young; and U.S. Pat. No. 3,849,241, issued Nov. 19, 1974, to Butin, et al.

As used herein "multilayer laminate" means a laminate wherein one or more of the layers may be spunbond and/or meltblown such as a spunbond/meltblown/spunbond (SMS) laminate and others as disclosed in U.S. Pat. No. 4,041,203 to Brock et al., U.S. Pat. No. 5,169,706 to Collier, et al, U.S. Pat. No. 5,145,727 to Potts et al., U.S. Pat. No. 5,178,931 to Perkins et al. and U.S. Pat. No. 5,188,885 to Timmons et al. Such a laminate may be made by sequentially depositing onto a moving forming belt first a spunbond fabric layer, then a meltblown fabric layer and last another spunbond layer and then bonding the laminate in a manner described below. Alternatively, the fabric layers may be made individually, collected in rolls, and combined in a separate bonding step. Such fabrics usually have a basis weight of from about 0.1 to 12 osy (6 to 400 gsm), or more particularly from about 0.40 to about 3 osy. Multilayer laminates for many applications also have one or more film layers which may take many different configurations and may include other materials like foams, tissues, woven or knitted webs and the like.

These terms may be defined with additional language in the remaining portions of the specification.

SUMMARY OF THE INVENTION

In light of the problems and issues discussed above, it is desired to have a single dry mop head that had an adjustable width to meet the various cleaning needs currently met by multiple mops. It is also desired to have a single substrate that would meet the needs of such varied head widths.

The present invention is directed to an adjustable-size mop head assembly that may be used with a handle and a disposable cleaning substrate. The mop head assembly includes a central frame section including a central portion and a lower substrate support surface configured to hold a disposable cleaning substrate. A head mount is positioned in the central portion of the central frame section and includes a socket mount configured to releaseably engage the mop handle. The mop head assembly also includes at least one adjunct frame section configured to be operably coupled to the central frame section and configured to move between a stored configuration, where the adjunct frame section is stored by the central frame section, and an extension configuration where the adjunct frame section extends from the central frame section to add width to the central frame section and the lower substrate support surfaces.

In some embodiments, the adjunct frame section may be a fold-out section coupled to the end of the central frame section with a hinge. In other embodiments, the adjunct section may include a telescoping section contained within the central frame section and configured to pulled out from the end of the central frame section. In some such embodiments, more than one adjunct frame section may be nested within the central frame section and configured to be pulled out from the end of the central frame section. In other embodiments the mop assembly may include at least one adjunct frame section telescopically engaged at each of the ends of the central frame section; a pair of opposing end caps, each coupled to one of the adjunct frame sections; and a telescopic transverse support rod couple to the pair of opposing end caps and extending proximate to the back edge of the central and adjunct frame sections, where the telescopic traverse support rod is configured to move between a stored configuration and an extended configuration.

In various embodiments, the mop assembly may include at least one fastener channel associated with the lower substrate support surface of the central frame section and at least one fastener strip configured to be inserted, contained, and removed from the fastener channel. Such fastener channels may also be included on the adjunct frame sections.

In some embodiments, the assembly may include a mop handle releaseably engaged with a socket mount on the mop head assembly. The mop handle may be a quick-release handle including a proximal end proximate to the mop head and a distal end distal to the mop head; a quick-release coupling assembly positioned on the proximate end of the handle, the quick-release coupling assembly configured to releaseably couple the handle to the head mount; and a button actuator positioned on the distal end of the handle, the button actuator operably connected to the quick-release coupling assembly. Additionally, in various embodiments, the handle may additionally include a coupler shroud that cooperatively couples with the head mount, the button actuator may be recessed within the end of the shaft, and the handle may include an ergonomic, freely-rotating knob. The head mount may also include a head coupler that permits the handle to move up and down and from side to side relative to the mop head assembly.

The present invention is also directed to a cleaning system that may be used with a handle. The cleaning system includes an adjustable-width mop assembly and a continuous web of disposable cleaning substrate including lines of weakness at regular intervals configured such that various widths of cleaning substrate are removable via the lines of weakness.

In various embodiments, the system may include a container that contains the continuous web of substrate and includes a dispensing opening through which the continuous web is dispensed. The container may also include a separator configured to aid in the separation of an individual disposable cleaning substrate from the continuous web of disposable cleaning substrate. Additionally, such a continuous web of disposable cleaning substrate may be in a roll format.

DETAILED DESCRIPTION

Figure 1:
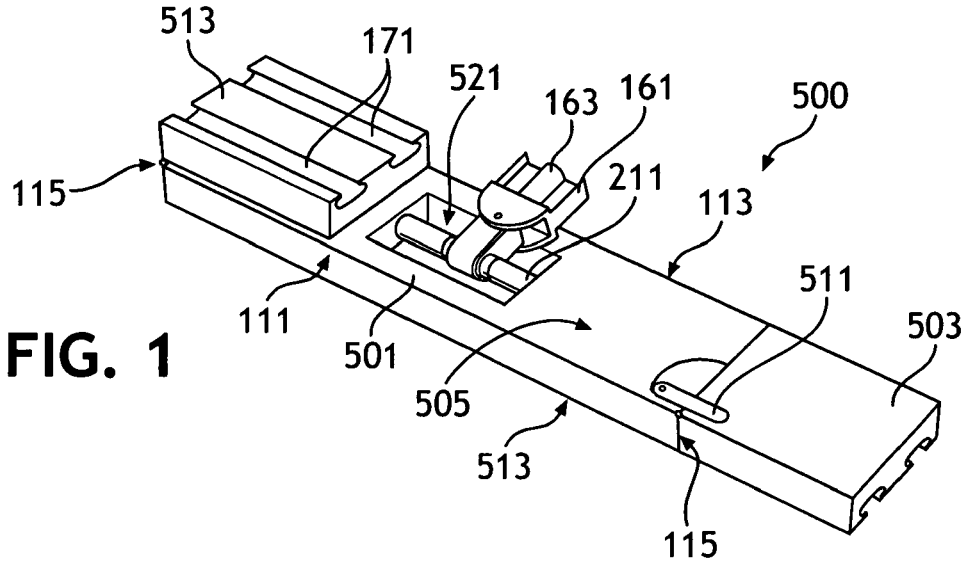
FIG. 1 is a perspective view of an expandable mop head according to the present invention.

Reference will now be made in detail to one or more embodiments of the invention, examples of which are illustrated in the drawings. Each example and embodiment is provided by way of explanation of the invention, and is not meant as a limitation of the invention. For example, features illustrated or described as part of one embodiment may be used with another embodiment to yield still a further embodiment. It is intended that the invention include these and other modifications and variations as coming within the scope and spirit of the invention.

Referring to FIGS. 1 to 4 in general, the mop head 500 of the present invention includes a central frame section to which a handle may be coupled. The mop head 500 additionally includes at least one adjunct frame section associated with the central frame section in such a way that the adjunct frame section may be manipulated into a position where such an adjunct frame section adds width to the mop head 500. When not being used to add width to the mop head 500, such an adjunct frame section is stored on or within the central frame section.

FIG. 1 illustrates one such possible adjustable-width mop head 500. The mop head 500 of the present invention includes a lower substrate support surface 513 to which a disposable cleansing substrate may be coupled during use of the mop head 500. As shown in FIG. 1, the mop head 500 may include a cross-member 211. The cross-member 211 positioned within the central portion 512 of the central frame section 501; the central portion 512 positioned near the centroid of the mop head 500, between the front edge 111 and back edge 113, and between the side edges 115 of the central frame section 501. A head mount 161 may be coupled to the cross-member 211 within the central position 521; the head mount 161 configured to releaseably couple the mop head 500 with a handle.

A pair of adjunct frame sections 503 may be coupled to the end edges 115 of the central frame section 501. Each adjunct frame section 503 may be coupled to the central frame section 501 such that the adjunct frame section 503 may be flipped down next to the end of the central frame section 501 and thereby increase the effective width of the mop head 500. When such width is not needed, the user may flip the adjunct frame section 503 back to its storage configuration resting on the upper surface 505 of the central frame section 501.

In a stored configuration, the adjunct frame sections 503 of the mop head 500 illustrated in FIG. 1 are flipped up to rest upon the upper surface 505 of the central frame section 501. In such a configuration, the mop will have the effective width of the central frame section 501. In an extended configuration, one or both of the adjunct frame section 503 may be flipped down to the ends 115 of the central frame section 501. The effective width of the extended configuration of the mop head 500 will be width of the central frame section 501 plus the added width of the adjunct frame section(s) 503 added to the ends of the central frame section 501. Additionally, the adjunct frame sections 503 may also be designed such that when they are configured into the extended configuration, the lower substrate support surfaces 513 of the central frame section 501 and adjunct frame sections 503 form one continuous surface upon which the disposable cleaning substrate may be coupled.

The adjunct frame sections 503 may be coupled to the central frame section 501 by any means or method that allows the adjunct frame sections 503 to move between the stored and extended configurations. For example, the adjunct frame sections 503 may be attached to the central frame section 501 by a hinge on the upper surface 505 of the central frame section 501 at the end edge 115. However, other coupling means or methods are well known and may be used.

Additionally, the mop head 500 may include one or more auxiliary brace(s) 511 to keep an adjunct frame section 503 in place during the use of the mop head 500 in an extended configuration. The mop head 500 illustrated in FIG. 1 includes a simple auxiliary brace 511 that pivots from the upper surface 505 of the central frame section 501 and restricts the ability of the adjunct frame section 503 from folding back into its stored configuration until the brace 511 is rotated from the adjunct frame section 503.

FIG. 1 illustrates a mop head 500 having two adjunct frame sections 503 that may be used to extend the width of the mop head 500. However, additional adjunct frame sections 503 may be included on the ends of the adjunct frame sections 503 that are shown in FIG. 1. Such additional frame sections 503 would allow for a greater number of specific widths that the mop head 500 could be configured.

Figure 2:
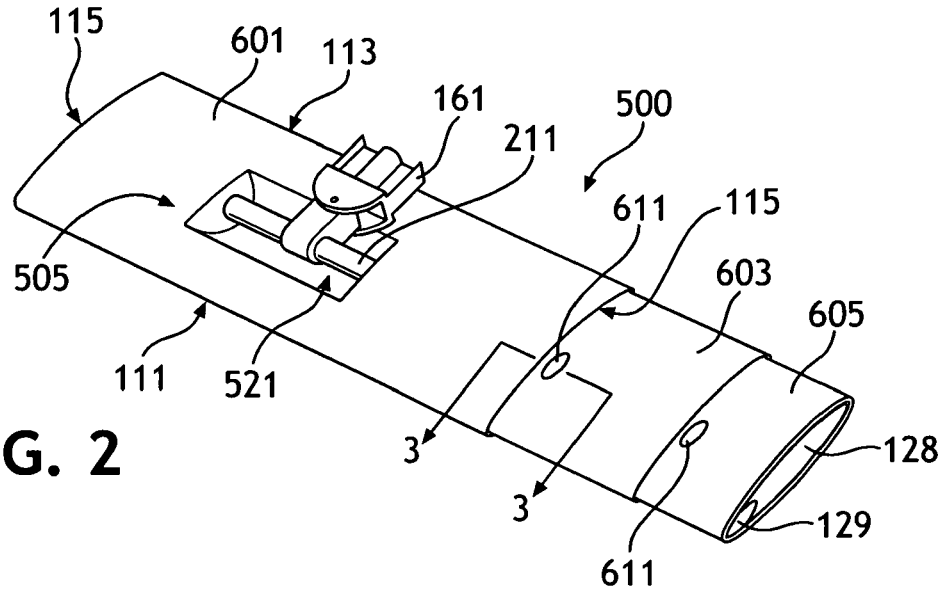
FIG. 2 is a perspective view of an expandable mop head according to the present invention.

Another adjustable-width mop head 500 configuration is illustrated in FIG. 2. The mop head 500 of FIG. 2 is similar to that shown in FIG. 1 except that the adjunct frame sections are nested when in a stored configuration and are capable of telescoping into an extended configuration. FIG. 2 shows a first telescopic adjunct section 603 and a second telescopic adjunct section 605 pulled out from the end edge 115 of the central frame section 601 and into an extended configuration. In the stored configuration, the second telescopic adjunct section 605 may fit within the first telescopic adjunct section 603, and both adjunct sections 603, 605 may then fit within the end of the central frame section 601.

The expansion and compaction of the mop head 500 of FIG. 2 may be aided by a finger hold 129 within the end plate 128 of the innermost nested telescopic adjunct frame section. Such a finger hold 129 could be used to pull the telescopic adjunct sections from the central frame section 601.

Figure 3:
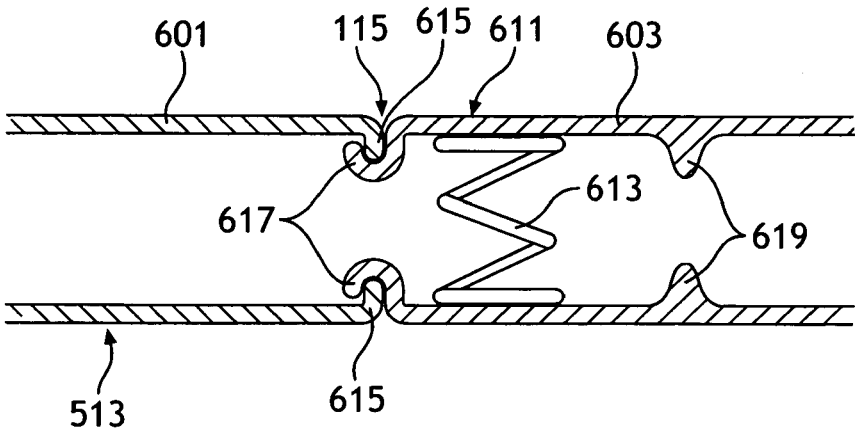
FIG. 3 is a partial cross-section view taken along the line 3-3 of the mop head of FIG. 2.

To minimize the disruption of the lower substrate support surface 513 at the interfaces of the central frame section 601 and subsequent telescopic adjunct sections 603, 605, the end edges of the sections 601, 603, 605 may be cooperatively configured. An example of such a cooperative configuration is illustrated in FIG. 3. The opposite ends of the sections may include paired features configured to engage one another. As shown, the end edge 115 of the central frame section 601 may include a lip 615 and the edge of the first telescopic adjunct frame section 603 may have a cooperative cup 617 that engages the lip 615.

A biasing means may additionally be included to engage the lip 615 with the cup 617 and keep the lower substrate support surface substantially continuous. In the example of FIG. 3, a helical compression spring 613 is present within the first telescopic adjunct section 603 as such a biasing means. Rather than use a spring 613 the tubular structure of the adjunct sections 603 may provide such biasing means. Other biasing means are possible.

With the use of such a biasing means, the telescoping adjunct section may additionally include a matching unlock depression 611 configured to counter the biasing means such that the lip 615 may be separated from the cup 617, and the section may be pushed back into the central frame section 601. In FIG. 2 such an unlock depression may be positioned on the upper surface 505 of the adjunct section 603 opposite the spring 613 on the inside of the section 603.

Additionally, section stops 619 may be included on the inside of such telescopic sections 603, to prevent the telescopic sections 605 nested inside from pushing farther into the interior of the subsequent section than desired. Such stops 619 may help ensure a desired stored configuration.

The mop head 500 illustrated in FIG. 2, only shows a first and a second telescopic adjunct frame section 603, 605 extending from the central frame section 601. Another set of adjunct sections 603, 605 may also be present on the opposite end of the central frame section 601. Additionally, more telescopic adjunct sections than shown in FIG. 2 may be nested within mop head 500 and provide the user with a greater number of possible extended mop head widths.

Figure 4:
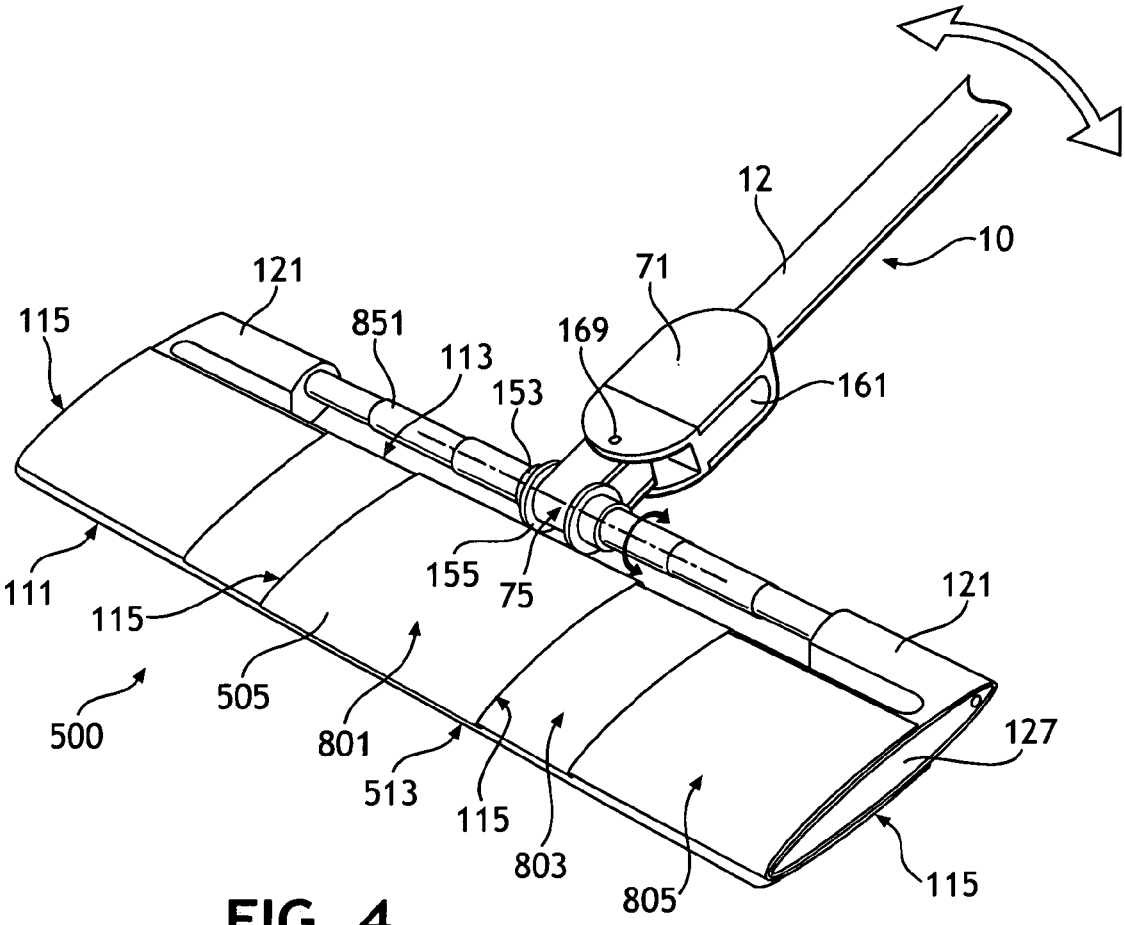
FIG. 4 is a partial perspective view of an expandable mop head according to the present invention, shown coupled with a quick-release handle.

An alternative mop head 500 using telescoping adjunct section is illustrated in FIG. 4. As shown, the mop head 500 includes a telescopic transverse support shaft 851 having a pair of end caps 121 at opposite ends of the shaft 851. A central frame section 801 and adjunct frame sections 803, 805 are supported by, and between, the end caps 121. A lower substrate support surface 513 and an upper substrate support surface 515 extend on opposite faces of the mop head 500 and extend between the end caps 121. A head mount 161 is coupled to the telescopic transverse support shaft 851 at a central position on the transverse support shaft 151 between the end caps 121. The head mount 161 is configured to releaseably couple the mop head 100 with a handle.

In use, a disposable cleaning substrate can be positioned upon the lower substrate support surface 513 and the upper substrate support surface 515 such that either side of the mop head 500 may be used to clean a floor (or other surface). When the cleaning substrate on floor-facing side of the mop head 500 becomes soiled, the mop head 500 may be flipped over such that the unused cleaning substrate surface becomes the floor-facing side of the mop head 500.

The cleaning substrate is supported upon a lower substrate support surface 513 and an upper substrate support surface 505. Both of these substrate support surfaces are preferably similar in size and shape. The terms "lower" and "upper" are used here to differentiate between the two substrate support surfaces for the sake of clarity in describing the mop head 500. These terms and are not intended to be limiting as to in-use position of the substrate support surfaces; in use, the lower substrate support surface 513 may be facing the floor to be cleaned (as shown in FIG. 4) and then the mop head 500 may be flipped over such that the upper substrate support surface 505 is then facing the floor to be cleaned.

As shown in FIG. 4, a pair of stop collars 153 may be used to keep the head mount 161 properly positioned relative to the telescopic transverse support shaft 851. Additionally, a pair of wheels 155 may also be included on the telescopic transverse support shaft 851. The wheels 155 may be positioned between the head mount 161 and the stop collars 153. During use, such wheels 155 may be included to help move the mop head 500 and keep the head mount 161 from rubbing on the surface to be cleaned.

The transverse support shaft 151 may be made from any material that meets the needs of the particular mop head 500. For example, a stronger telescopic transverse support shaft 851 may be desired for commercial applications while a lighter shaft may be desired for home applications. Other considerations may include, but are not limited to, weight, durability, compatibility with chemicals and substances the handle may come in contact, appearance, ease of cleaning, colors available, disposability, and the like. Typically, the support shaft 851 may be made of a metal, plastic, or wood. More particularly, the support shaft 851 may be made of aluminum, stainless steel, ABS-plastic, or the like. Again, one skilled in the art would see how such variables could be balanced to produce the transverse support shaft 851.

As seen in FIGS. 1 and 2, the end caps 121 are coupled to opposite ends of the telescopic transverse support shaft 851. The coupling of the end caps 121 and the support shaft 851 may be accomplished by any method or fastener as are known by those skilled in the art. By way of non-limiting examples, the support shaft 151 may be coupled to the end cap 121 by an adhesive, a screw, a bayonet mount, a threaded mount, a friction fitting, or other similar fixture or fastener.

The first telescoping adjunct section 803, second telescoping adjunct section 805 and central frame section 801 would interact to move between a stored configuration and an extended configuration in the same fashion as the mop head 500 illustrated and discussed for FIGS. 2 and 3. The difference with the mop head 500 of FIG. 4 is that the telescoping transverse support shaft would telescope in the same manner as the central frame section 801 and adjunct sections 803, 805.

The mop head 500 of FIG. 4 may be pulled into an extended configuration by pulling apart the end caps 121 or may be pushed into a stored configuration by pushing the end caps 121 toward each other. The width of the mop head 500 may be determined by set width positions to which the end caps 121 may be pulled. Alternatively, the head 500 may be configured to be any width to which the telescopic transverse support shaft 851 may be pulled.

The mop head 500 of FIG. 4 may be designed such that the telescoping transverse support shaft 851 extends in one direction and only may be compacted upon being pulled to its ultimate length. With such a support shaft 851, the user could pull the end caps 121 apart to any desired width and the sections 801, 803, 805 would be locked into position. When the user desired to put the mop head 500 in a stored configuration, they would pull the end caps 121 apart to the ultimate length of the support shaft 851, at which point the mop head 500 could collapse into its nested stored configuration. Such a support shaft 851 may additionally be spring loaded such that the head 500 would snap into its stored configuration upon the end caps 121 being pulled apart to the ultimate length of the support shaft 851.

As shown in FIGS. 1, 2 and 4, the mop head 500 may be generally rectangular in shape with a side-to-side width (the distance between the ends of the mop head 500), whether in a stored configuration or in an expanded configuration, greater than its front-to-back depth (the distance between the front edge 111 and the back edge 113 of the mop head 500). However, the mop head 500 may be any size and shape, symmetrical or asymmetrical that is desired for the particular cleaning needs being addressed. Generally, the mop head 500 may have a front-to-back depth of between about 4 inches (102 mm) and about 16 inches (406 mm), though other sizes are possible. The side-to-side width of the mop head 500 may be between about 6 inches (152 mm) and about 24 inches (610 mm) in a stored configuration, and between about 14 inches (356 mm) and about 72 inches (1.8 m) in an expanded configuration.

By way of non-limiting example, a mop head 500 intended for commercial use may have a depth of about 12 inches (305 mm), a compacted width of about 24 inches (610 mm), and a potential expanded width of 72 inches (1.8 m); with widths between 24 inches and 72 inches available depending on how the adjunct frame sections are configured by the user. A mop head 500 intended for domestic use may have a depth of about 6 inches (152 mm), a compacted width of about 10 inches (254 mm), and a potential expanded width of 24 inches (610 mm); widths between 10 inches and 24 inches available depending on how the adjunct frame sections are configured by the user. These are only exemplary dimenstions and are not intended to be limiting; the dimensions of the mop head 500 may be any width and depth that is desired to meet the particular cleaning application.

A mop head 500 of the type illustrated in FIG. 1 is substantially uniform in its thickness between the front edge 111 and the back edge 113 of the mop head 500. Generally such a mop head 500 may have a thickness between about 0.5 inches (12.2 mm) and about 2 inches (50.8 mm), though other sizes are possible.

As illustrated in FIGS. 2 and 4, the lower substrate support surface 513, may be slightly convexly curved between the front edge 111 and the back edge 113 of the mop head 600, 800. Resultantly, the cross-sectional profile of such a mop head 500 may be generally oblate in shape, however other shapes, symmetrical and asymmetrical, are possible. Thus the thickness of the mop heads 500 may vary between the front and back of the mop head 500. Generally, the mop head 500 may have a thickness between about 0.5 inches (12.2 mm) and about 2 inches (50.8 mm) in the center and be thinner at both the front edge 111 and back edge 113, though other sizes and cross-sectional profiles are possible.

The lower substrate support surface 513 may be made from any material that meets the needs of the particular mop head 500. For example, the lower substrate support surface 513 may be desired for commercial applications may utilize a heavier and/or stronger material, while a lighter material may be desired for home applications. Other considerations may include, but are not limited to, weight, durability, compatibility with the cleaning substrate(s) to be used, compatibility with chemicals and substances the surface 513 may come in contact, appearance, ease of cleaning, colors available, disposability, and the like. Typically, the lower substrate support surface 513 may be made of a metal or plastic. More particularly, the lower substrate support surface 513 may be made of aluminum, stainless steel, ABS-plastic, or the like. One skilled in the art would see how such variables could be balanced to produce the lower substrate support surface 513.

As discussed above, the lower substrate support surface 513 may be convexly curved from the front edge 111 to the back edge 113 of the mop head 500. Traditional dry dust mops, disposable cleaning substrate mops, and sponge mops typically have a flat surface that contacts the surface to be cleaned (i.e., a floor). Such a flat-contacting surface maximizes the contact of the mop head or substrate with the floor, however, dust, dirt and debris tends to pile up at the edges of such mops, leaving the central portion of the mop or substrate unused. By providing a slight convex curve to the lower substrate support surface 513 of the present invention, a greater percentage of the entire cleaning substrate surface may be used.

The upper substrate support surface 515 of the mop head 500 of FIG. 4 may be made of the same materials and have the same convex curvature as discussed for the lower substrate support surface 513. However, the upper substrate support surface 515 may alternatively be different than the lower substrate support surface. The same design considerations applied to the lower substrate support surface 513 would apply to the upper substrate support surface 515.

The mop head 500 of the present invention is intended to be used with a disposable cleaning substrate 83. Such cleaning substrates are widely available and well understood. Typically such substrates may be woven, nonwoven, laminates, composites, or combinations thereof, and may be made from natural fibers, synthetic fibers, or combinations thereof. By way of non-limiting examples, the disposable cleaning substrate may be a spunbonded polypropylene material, a knitted polyester substrate, a microfiber substrate made with a polyester/polyamide yarn, a stabilized open-cell thermoplastic foam laminate, a hydroentangled nonwoven composite material, a sponge substrate, or other such substrates as may be desired for particular cleaning needs.

Additionally, such cleaning substrates may be provided as a dry substrate or as a saturated substrate. The cleaning substrate may include additional substances such as cleansers, disinfectants, sanitizers, fragrances, or the like. The disposable cleaning substrate may also be electric treated to impart a static electric charge to the material to attract dust to the charged substrate. Similarly, the disposable cleaning substrate may be made from particular materials (such as rubber, spunbonded polypropylene, spunlace fabrics, or combinations thereof) that may develop such a static electric charge during it use on particular surfaces.

The disposable cleaning substrate may be wrapped across the lower substrate support surface 513 and coupled to the mop head 500. The cleaning substrate may be coupled to the mop head 500 by any substrate coupling as are known and commonly found with such mops that utilize disposable cleaning substrates. Non-limiting examples of such substrate coupling may include ties, clamps, clips, teeth, screws, attachment structures, adhesives, hook-and-loop fasteners, and other such fasteners, or combinations thereof. For the mop heads 500 illustrated in FIGS. 1 and 2, such substrate coupling may be present near to the front edge 111 and the back edge 113 of the mop head 500. Additionally, or alternatively, such substrate coupling may be present on the upper surface 505 of the mop head 500. The mop head 500 may utilize one or more such substrate couplings and may include more than one type of such couplers.

For the reversible mop head 500 illustrated in FIG. 4, the disposable cleaning substrate may be wrapped from the back edge 113 of the lower substrate support surface 513, toward the front edge 111 of the mop head 500, over the upper substrate support surface 515, and to the back edge 113. The singular sheet cleaning substrate may be positioned proximate to the back edge(s) 113.

Figure 5:
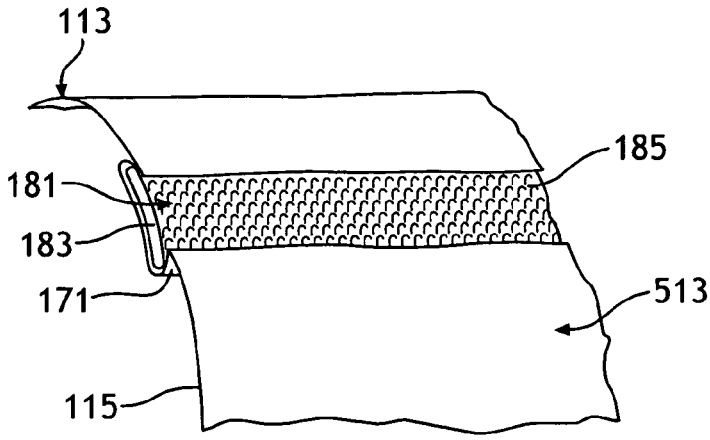
FIG. 5 is a partial perspective view of a fastener channel including a fastener strip associated with the substrate support surface of the mop head.

One particular structure that may be used to couple the disposable cleaning substrate to the mop head 500 is a fastener channel 171 and a cooperative fastener strip 181. FIGS. 1 and 5 illustrate fastener channels 171 that may be included on the mop head 500 of the present invention. The fastener channels 171 are preferably associated with the lower substrate support surface 513 to couple a disposable cleaning substrate to the mop head 500. Such fastener channels 171 extend from the end edges 115 of the mop head 500 so that fastener strips 181 may be easily inserted into the fastener channels 171. As seen in FIG. 1, the fastener channels 171 are preferably located near the front edge 111 and back edge 113 of the lower substrate support surface 513 and extend generally parallel to such edges 111, 113. Similarly, fastener channels 171 may also be associated with the lower substrate support surface 512 of the adjunct frame sections 503.

As seen in FIG. 5, the fastener channel 171 may be configured in such a way as to securely retain the fastener strip 181 within the channel 171 while allowing the particular fastener 185 of the strip 181 to extend out of the plane of the lower substrate support surface 513 to engage a disposable cleaning substrate. Typically, as shown in FIG. 5, the fastener strip 181 includes a fastener 185 and a backing 183 that secures the fastener 185 to the strip 181. The backing 183 additionally provides some degree of rigidity to the fastener strip 181, such that the fastener strip 181 is not easily pulled out of the fastener channel 171 by any manner other than from the end edge 115 of the mop head 500.

The fastener 185 present on the fastener strip 181 may be any fastener attached to a backing strip 183 that is compatible with the particular cleaning substrate material to be affixed to the mop head 500. The fasteners may be appropriate to directly attach to the substrate material or they may cooperatively couple with a substrate fastener 93 (see FIG. 13) included on the cleaning substrate 85. Non-limiting examples of such fasteners that may be used with the fastener strips 181 may include independent fasteners such as hook fasteners (as shown in FIG. 5), pressure-sensitive adhesives, and the like, as well as cooperative fasteners such as hook-and-loop fasteners, snaps, magnets, buttons, and the like.

Additionally, different types of fastener strips 181, each utilizing a different type of fastener 185, may be provided to accommodate a variety of different disposable cleaning substrates that the user may want to utilize. For example, a fastener strip having an adhesive fastener may be provided for a cleaning substrate laminate having a film backing layer, a fastener strip having a hook fastener may be provided to accommodate a spunbonded polypropylene cleaning substrate, and a more tenacious hook fastener may be provided on yet another fastener strip to accommodate a microfiber cleaning substrate intended for more vigorous cleaning. One skilled in the art would understand that different types of fasteners work better with different types of substrates and would be able to provide an appropriate variety of fastener strips to accommodate the substrates that a user intends to utilize.

Referring to FIGS. 7 to 11 in general, the quick-release handle 10 that may be used with the mop head 500 of the present invention includes an elongated shaft 12 having two opposite ends; a proximal end 16 and a distal end 18. The proximal end 16 is proximate to the mop head 500 to which the handle 10 is to be attached. The distal end 18 is distal to the proximal end 16 and proximate to the user. The proximal end 16 includes the quick-release coupling assembly 20 that will cooperate with and couple the handle 10 to a mop head 500. The proximal end 16 is also considered as the attachment end of the handle 10 and the terms "proximal end" and "attachment end may be used interchangeably.

Generally, the distal end 18 will have a grip 41 by which the user may grasp the handle 10. The distal end 18 is also considered the grip end of the handle 10 and the terms "distal end" and "grip end" may be used interchangeably. Additionally, the distal end 18 accommodates the button actuator 45 which the user depresses to release the coupling assembly 20 from any mop head 500 that may be coupled with the proximal end 16 of the handle 10. Thus, the user can release a mop head 500 from the handle 10 by manipulating the distal end 18 rather than repositioning the handle, bending over, or going anywhere near the potentially dirty proximal end 16 of the tool.

Figures 6, 7:
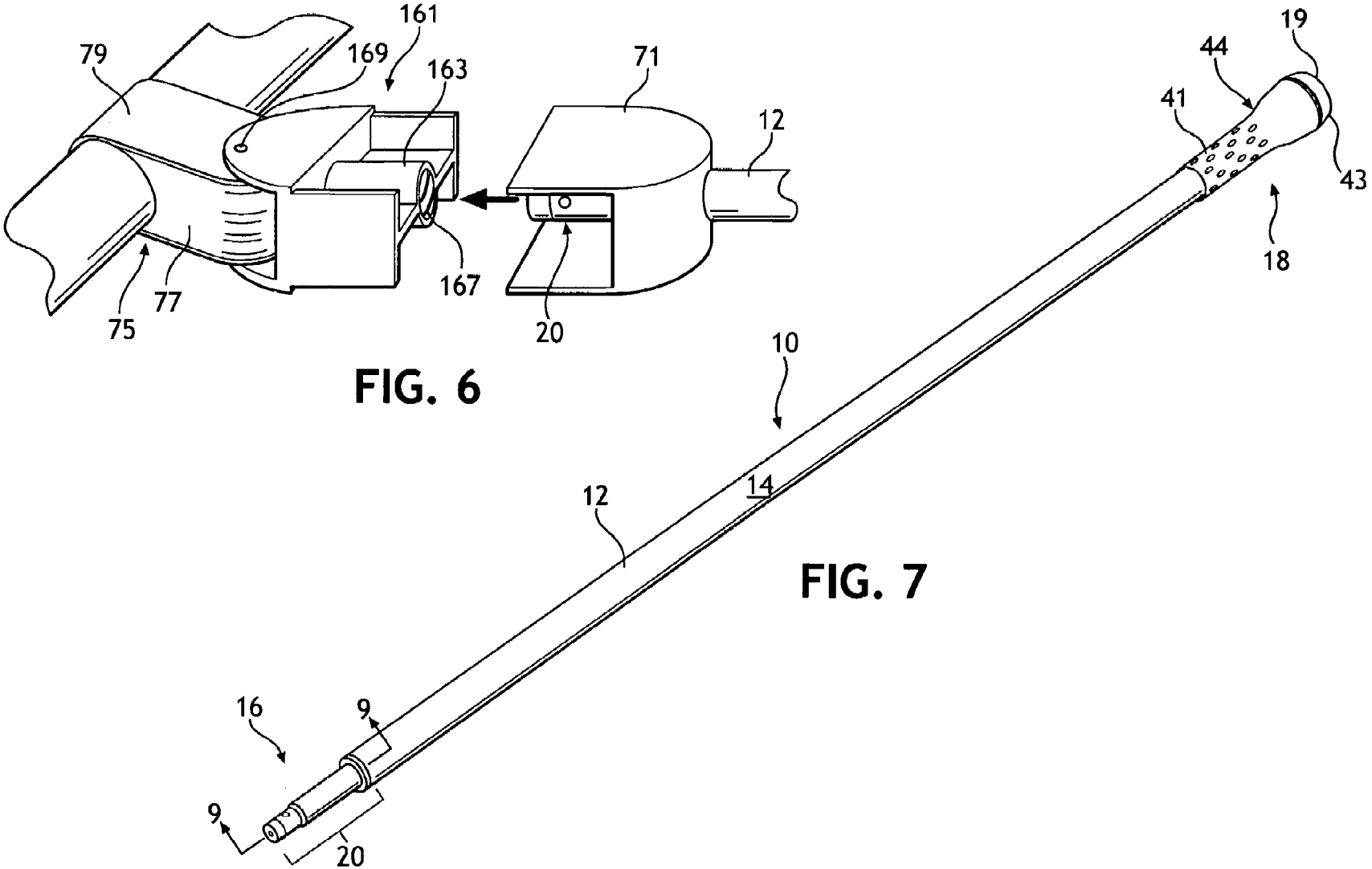
FIG. 6 is a partial perspective view of a head mount of the mop head of FIG. 1, the head mount positioned to engage the coupling assembly of the quick-release handle.
FIG. 7 is a perspective view of the quick-release handle.

The elongated shaft 12 is shown in FIG. 7 as generally cylindrical in shape, having a circular cross-section, as is common for most commonly available long tool handles. As such, the elongated shaft 12 has a single peripheral surface 14. However, other cross-sectional shapes are contemplated and are considered within the scope of the present invention. By way of non-limiting examples, the cross-sectional shape of the elongated shaft 12 may be elliptical, polygonal, or any other symmetrical or asymmetrical shape. Any such alternative cross-sectional shape may provide the elongated shaft 12 with additional peripheral surfaces 14.

Generally, it is desired that the elongated shaft 12 have a length of about 36 inches (0.9 m) to about 72 inches (1.8 m). For a quick-release handle 10 for use with cleaning tool mop heads 500, the elongated shaft will preferably be about 5 feet (1.5 m) in length, similar to the length of commonly available tool handles. The elongated shaft 12 should have an outside diameter suitable for the intended tool mop heads 500 and that is comfortable for use by range of user hand sizes. Typically, the outside diameter will be in the range of about 0.5 inches (12.7 mm) to about 1.5 inches (38.1 mm). Preferably, the outside diameter of the shaft 12 will be similar to that of commonly available handles, 0.75 inches (19.1 mm). Also, the shaft 12 illustrated in FIG. 1 is generally uniform in its diameter from the proximal end 16 to the distal end 18. However, the shaft 12 may alternatively have a non-uniform diameter along its length and may have sections of uniform and non-uniform diameter along its length.

The elongated shaft 12 is hollow to accommodate the push rod 31 and the other associated elements of the button actuator 45 and quick-release coupling assembly 20. The hollowed nature of the shaft 12 also decreases the weight of the handle 10 and the amount of material used in making the handle 10. The thickness of the hollow elongated shaft 12 is a function of the materials used to make the shaft 12, the inside diameter required to accommodate the elements to be accommodated within the shaft 12, and the strength and weight desired. One skilled in the art would see how such variables could be balanced to produce the desired shaft 12.

The elongated shaft 12 may be made from any material that meets the needs of the various mop heads 500 with which such a handle 10 is expected to be used. For example, a stronger shaft 12 may be desired for commercial applications while a lighter shaft may be desired for home applications. Other considerations may include, but are not limited to, weight, durability, compatibility with chemicals and substances the handle may come in contact, appearance, ease of cleaning, colors available, disposability, and the like. Typically, the shaft 12 may be made of a metal, plastic, or wood. More particularly, the shaft 12 may be made of aluminum, stainless steel, ABS-plastic, or the like. Again, one skilled in the art would see how such variables could be balanced to produce the desired shaft 12.

Additionally, designs in which the shaft 12 is telescoping, collapsible, and/or foldable are also considered to be within the scope of the present invention.

As discussed above, the quick-release coupling assembly 20 is positioned on the proximal end 16 of the handle 10 and is configured to be coupled with a mop head 500. The coupling assembly 20 may utilize any releasable coupling mechanism, as are well known, to releaseably couple with a mop head 500. By way of non-limiting examples, such a releasable coupling mechanism may utilize a detent ball assembly (as illustrated in FIGS. 8, 9A and 9B), a collet, a chuck, a clamping spring, a bayonet mount, a barbed fastener, a ribbed shank clip fastener, or other such mechanisms or any combination thereof.

The mechanism of the coupling assembly 20 is actuated by the user pressing and releasing the button actuator 45 on the distal end 18 of the shaft 12. The button actuator 45 is operably connected with the coupling assembly 20 by the push rod 31 which extends along the length of the shaft 12, from the button actuator 45 to the coupling assembly 20. As can be seen in the example illustrated in FIGS. 8, 9A, 9B, 10A, 10B and 11, the button actuator 45 is the terminus of the push rod 31 on the distal end 18 of the handle 10. At the proximal end of the push rod 31, a stop collar 33 is fitted around and attached to push rod 31 by a pin 34. A spring 35 around the push rod 31 and compressed between the stop collar 33 and the end wall of the stepped tip 21 of the coupling assembly 20 keeps the push rod 31 biased toward the distal end 18.

Figure 8:
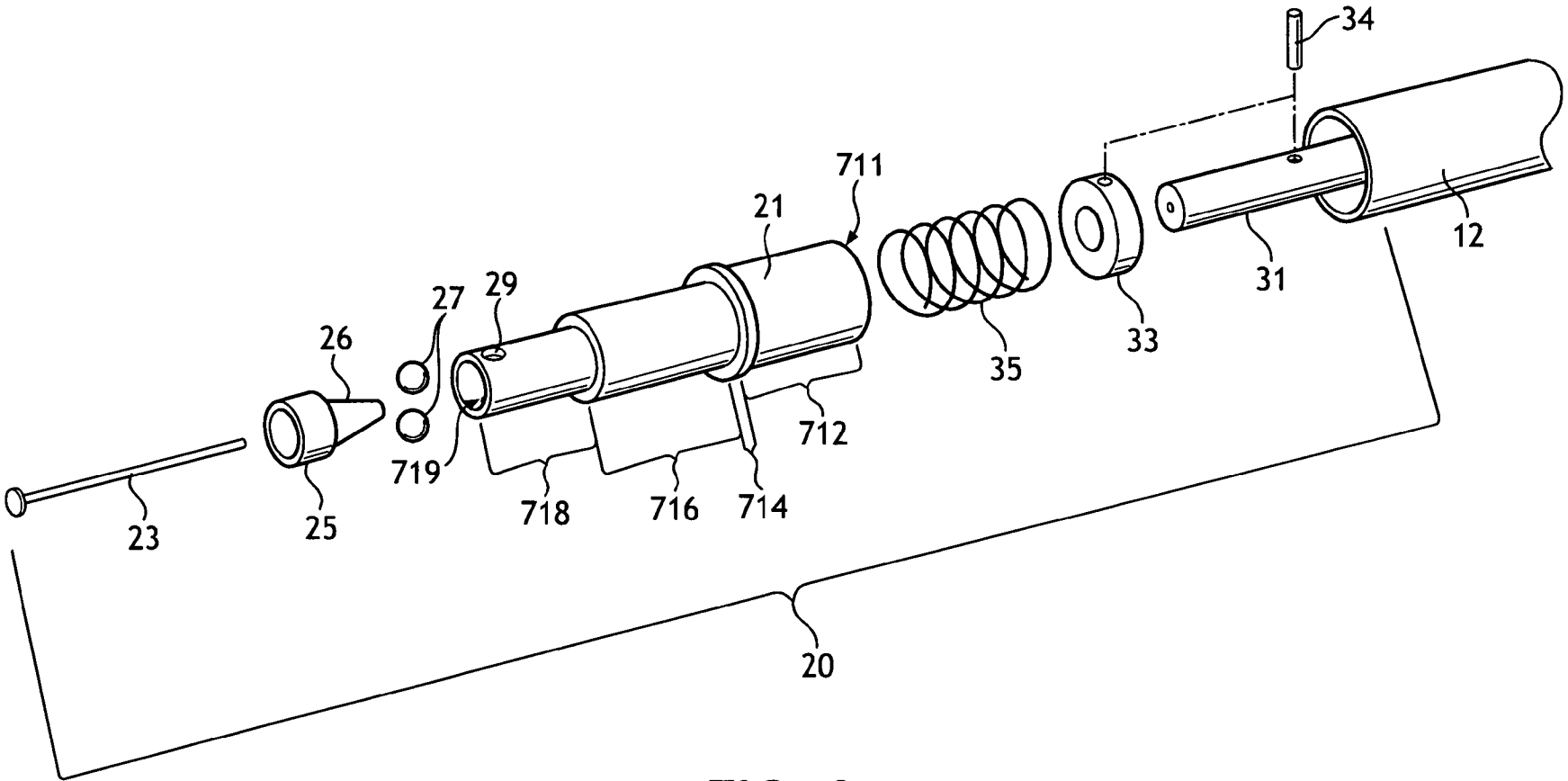
FIG. 8 is a partial perspective exploded view of a quick-release coupling assembly of the handle of FIG. 7.
Figure 9A:
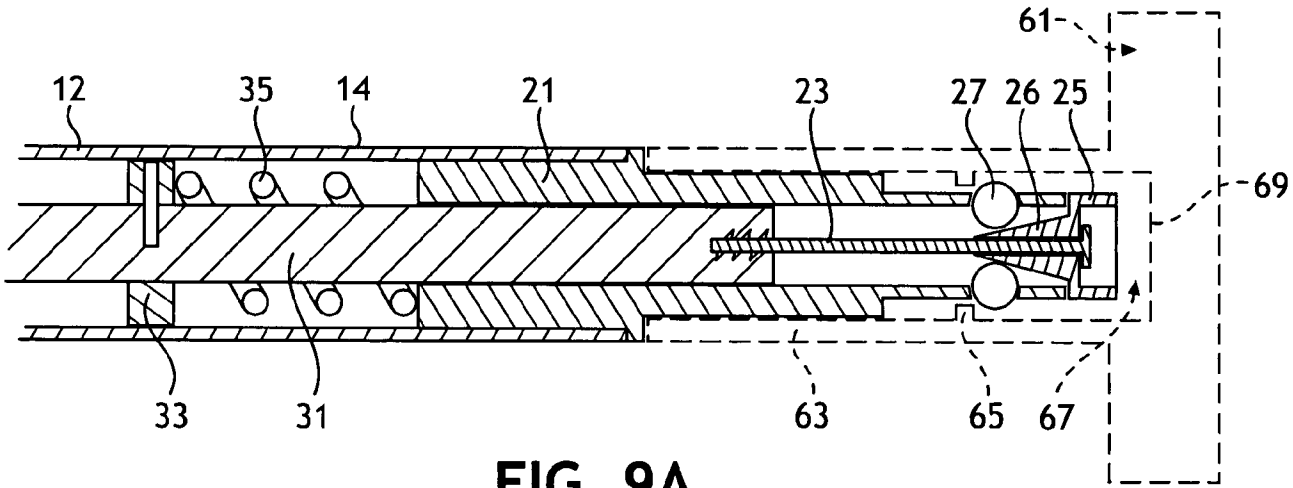
FIG. 9A is a cross-sectional view of a quick-release coupling assembly of the handle of FIG. 7 taken along line 9-9, shown in an engaged configuration with a generic socket mount (illustrated by phantom lines)
Figure 9B:
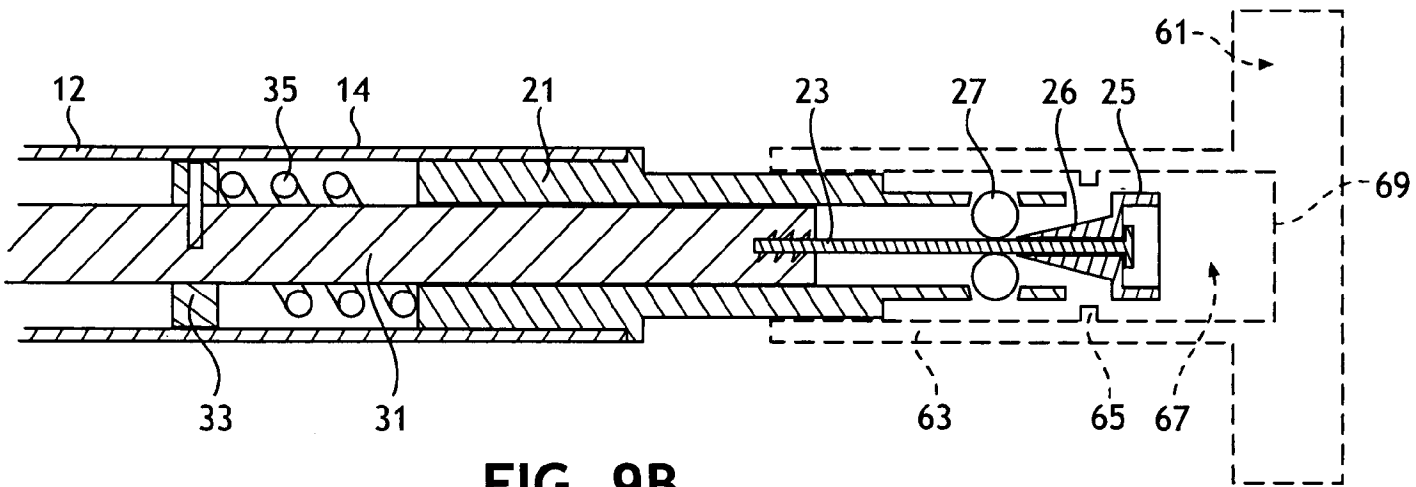
FIG. 9B is a cross-sectional view of the quick-release coupling assembly of the handle of FIG. 7 taken along line 9-9, shown in a release configuration in relation to the generic socket mount (illustrated by phantom lines)

As shown in FIGS. 8, 9A, and 9B, the coupling assembly 20 at the proximal end 16 of the shaft 16 includes a stepped tip 21 having a first end 711 inserted into the proximal end 16 of the shaft 12 and a second end 719 that extends from the end of the shaft 12 and into the socket mount 63 of a head mount 61 of a working head to which the handle 10 is to be coupled. The stepped tip 21 has an internal longitudinal channel 22 that extends the length of the stepped tip 21, from the first end 711 to the second end 719. The first section 712 of the stepped tip 21 near the first end 711 has a diameter slightly smaller than the inside diameter of the shaft 12 such that the stepped tip 21 may be snuggly fit into the proximal end 16 of the shaft 12. A lip section 714 of the stepped tip 21 seats the stepped tip 21 in the proximal end 16 of the shaft 12 and prevents the stepped tip 21 from being pushed further into the shaft 12.

As illustrated in FIGS. 9A and 9B, once the stepped tip 21 is installed in the shaft 12, the push rod 31 extends into the longitudinal channel 22 of the stepped tip 21. A stop rod 23 extends from the proximal end of the push rod 31 and is attached to the end of the push rod 31. The stop rod 23 extends out of the longitudinal channel 22 at the second end 719 of the stepped tip 21 and is capped by a head portion 25. The head portion 25 has a conical portion 26 that extends around the stop rod 23 inside the longitudinal channel 22. When the stop rod 23 is attached to both the push rod 31 and the head portion 25, the spring 31 that biases the push rod 31 toward the distal end 18 (as discussed above) also pulls the head portion 25 against the second end 719 of the stepped tip 21.

The third section 718 of the stepped tip 21 additionally includes ports 29 that extend from the longitudinal channel 22 to the outer surface of the stepped tip 21. A single detent ball 27 is retained by each port 29 and against the stop rod 23 or the conical portion 26.

When the handle 10 and coupling assembly 20 are in the engaged configuration, such as shown in FIG. 9A, the spring 35 between the stop collar 33 and the first end 711 of the stepped tip 21 biases the push rod 31 toward the distal end 18 of the shaft 12. The stop rod 23 attached to both the head portion 25 and the push rod 31 is subsequently pulled into contact with the second end 719 of the stepped tip 21. The head portion 25 is only pulled to the second end 719 and thus the spring 35 cannot push the push rod 31 further toward the distal end 18 or pull the stop rod further into the stepped tip 21. In such an engaged configuration, the coupling assembly 20 and push rod 31 are held in a neutral state by the spring 35.

As shown in FIG. 9A, when the coupling assembly 20 is in the engaged state, the head portion 25 is pulled to the second end 719 of the stepped tip 21 such that the conical portion 26 of the head 25 is pulled into the longitudinal channel 22. The conical portion 26 engages the detent balls 27 and pushes them into the ports 29 such that the detent balls partially extend outside of the exterior wall of the third section 718 of the stepped tip 21.

FIG. 9B illustrates the release configuration of the handle 10 and coupling assembly 20. When the user depresses the button actuator 45 at the distal end 18, the push rod 31 and the stop collar 33 is pushed toward the proximal end 16 of the shaft 12, compressing the spring 35 between the stop collar 33 and the first end 711 of the stepped tip 21. The stop rod 23, including the head 25, is consequently pushed away from the second end 719 of the stepped tip 21. As the conical portion 26 of the head 25 is pushed toward the second end 719, the detent balls 27 are allowed to fall back into the longitudinal channel 22 and against the stop rod 23. When the user releases the button actuator 45, the spring 35 returns the handle 10 to the engaged, or neutral, configuration as illustrated in FIG. 9A.

Various working heads could be used with this type of handle 10 and coupling assembly 20. To work with the coupling assembly 20, the particular working head should include a head mount 61 that includes a socket mount 63 into which the coupling assembly 20 may be inserted. A retention stop 65 within the socket mount 63 cooperatively engages with the coupling assembly 20 to securely couple the working head and the quick-release handle 10. Such a retention stop 65 may be anything within the socket mount 63 that cooperatively engages the detent balls 27 of the coupling assembly 20. By way of non-limiting examples, the retention stop 65 may be a ring fixed within the socket mount 63 (as shown in FIGS. 9A and 9B), recesses within the wall of the socket mount 63, holes in the socket mount 63, or another configuration which can engage the detent balls 27.

In operation, when the coupling assembly 20 is inserted into the socket mount 63, the stepped tip 21 would proceed from the mouth of the socket recess 67 toward the recess terminus 67. When the coupling assembly 20 is in the engaged (neutral) configuration, the detent ball 27 are pushed out of the ports 29 by the conical portion 26 of the head 25, as discussed above. The inside diameter of the ring used as the retention stop 65 shown in FIGS. 9A and 9B is designed to be slightly larger than the outer diameter of the third portion 718 of the stepped tip 21. Thus, as the stepped tip 21 is inserted into the socket mount 63, the third portion 718 snugly passes into the retention stop 65, but the protruding detent balls 27 will come into contact with the retention stop 65. As the user continues to apply insertion pressure to the stepped tip 21, the detent balls 27 are forced into the ports 29 and push against the conical portion 26 and consequently push the head 25 from the second end 719. Once the stepped tip 21 is pushed farther into the socket mount 63, the detent balls 27 clear the retention stop 65 and are again forced out of the ports 29 by the conical portion 26. The detent balls 27 engage the retention stop 65 as illustrated in the engaged configuration shown in FIG. 9A.

The socket mount 63 includes a socket recess 67 on the recess terminus side of the retention stop 65. Such a recess 67 allows enough room for the head 25 to extend from stepped tip 21 as necessary for the detent balls 27 to drop inside the stepped tip 21 during insertion of the coupling assembly 20 or release of the working head, as discussed above.

The use of a coupling assembly 20 with the detent ball 27 mechanism described and illustrated in FIGS. 8, 9A and 9B, is only one possible coupling assembly 20 that may be used in the handle 10 of the present invention. As discussed above, other coupling mechanisms are contemplated for the coupling assembly 20 to couple the handle 10 with a mop head 500 and operably connect to the button actuator 45 such that the mop head 500 is released from the handle 10 when the button actuator 45 is manipulated.

For increased universality, the socket mount 63 may additionally be threaded from the mouth of the socket mount 63 to the retention stop 65. Such a socket mount 63 could then also accept a standard handle with a thread tip, if the user so desired.

The second section 716 of the stepped tip 21 is designed to have an outside diameter slightly smaller than the inside diameter of the socket mount 63. This ensures that the coupling assembly 20 snuggly fits within the socket mount 63 such that the mop head 500 is securely and solidly held at the end of the handle 10. If the socket mount 63 is threaded, the second section 716 would need to have an outside diameter slightly smaller that the threads.

Although not shown, a second spring could be included inside of the socket mount 63, attached to the recess terminus 69. Such a spring would be compressed upon insertion of the coupling assembly 20 into the socket mount 63. When the button actuator 45 was subsequently pressed to release the mop head 500 from the handle 10, such a spring would then bias the socket mount 63 off of the coupling assembly 20.

Additional stability may be added to the connection of the mounting head of the mop head 500 and the coupling assembly 20 by the inclusion of a coupler shroud 71 at the proximal end 16 of the shaft 12. As shown generally in FIGS. 4 and 6, the coupler shroud 71 has portions that both protect the exposed coupling assembly 20 from damage and cooperate with the designs of the head mounts to securely couple the mop head 500 and handle 10.

As shown in FIGS. 4 and 6, the coupler shroud 71 and the head mount 161 are cooperatively designed such that coupler shroud 71 fits within the head mount 161 and the heat mount 161 fits within the coupler shroud 71. Such a cooperative design ensures a snug and solid coupling of the mop head 500 attached to the head mount 161 and the handle 10. Such a mop head 500 would be unable to rotate about the shaft axis. Additionally, such a head mount 161 along with the coupler shroud 71 could help protect the coupling assembly 20 from damage and minimize the contact the coupling assembly 20 has with the outside environment during use.

As shown in FIGS. 1, 2, 4 and 6, additional functionality may be added to a head mount 161 by including a head coupler 75. The head coupler 75 connects the head mount 161 to the mop head 500. The head coupler 75 may include a coupler bracket 79 that fits around a portion of the mop head 500. For the mop heads 500 illustrated in FIGS. 1 and 2 the coupler bracket 79 is fitted around the cross-member 211; for the mop head 500 illustrated in FIG. 4 the coupler bracket 79 is fitted around the telescoping transverse support rod 851. A coupler spacer 77 cooperates with the coupler bracket 79 to hold the coupler bracket 79 against the cross-member 211. A pin 169 through the head mount 161, coupler bracket 79, and the coupler spacer 77 couples the head mount 161 and head coupler 75.

The head coupler 75, as shown in FIG. 4, allows the head coupler 75, the attached head mount 161, and the coupled quick-release handle 10 to rotate about the telescoping transverse support rod 851 (or about the cross-member 211 in the mop heads 500 of FIGS. 1 and 2) and consequently allows the distal end 18 of the handle 10 to move vertically relative to the floor and the mop head 200. Additionally, the head coupler 75 is designed to interact with the head mount 161 such that the head mount 161 and coupled handle 10 may pivot on the pin 169 of the head coupler 75 such that the distal end 18 of the handle 10 may be pivoted from side-to-side, relative to the mop head 500.

Additionally, when the mop heads 500 of FIGS. 1 and 2 include such a head coupler 75, any handle coupled to the head mount 161 may be rotated to either side of mop head 500. Thus, when in use, either the front edge 111 or the back edge 113 of the mop head 500 may act as the leading edge of the mop assembly. This type of mop head 500 configuration along with a convexly curved lower substrate support surface 513 may help maximize the usage of a coupled disposable cleaning substrate.

To aid the user in grasping the handle 10, the distal end 18 may be equipped with a grip 41 and a knob 43. The grip 41 has a slightly larger diameter than the shaft 12 and is preferably made of material, or is otherwise designed, to facilitate grasping of the shaft 12. Additionally, such a grip 41 should be designed to have the necessary durability required for the typical use of such handle 10. For example, the grip 41 may be made of rubber, plastic, metal, or the like. Such materials may be given a texture through processing or through design by the addition of ridges, patterns, or divots to the surface of the grip 41 (as shown in FIGS. 7, 10A and 10B).

The grip 41, as shown in FIGS. 7, 10A, 10B and 11, may additionally have a knob 43 that also provides the user with more comfort than a traditional stick used with common brooms or mops. Generally, such traditional sticks merely have the end rounded off and cause fatigue to the user's hand and often result in blisters and calluses in the palm of the hand after extended use. The small diameter of the end of such traditional sticks causes discomfort and is often difficult for the user to fully grasp.

Figure 10A:
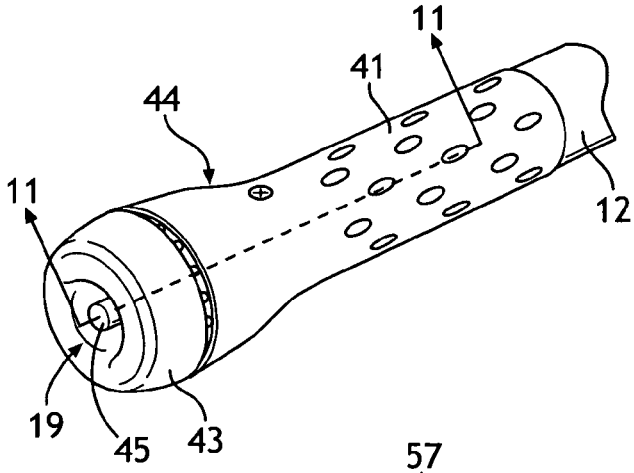
FIG. 10A is a partial perspective view of the distal end of the quick-release handle of FIG. 7 showing a grip, a freely-rotating knob, and a button actuator.
Figure 10B:
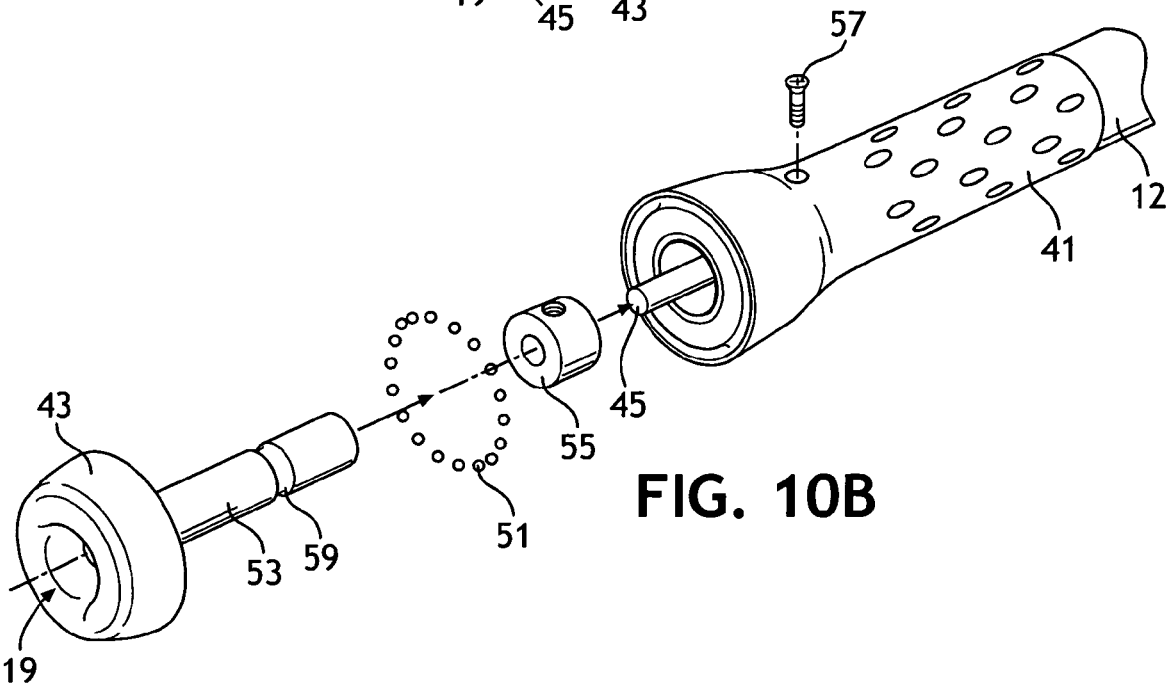
FIG. 10B is a partial perspective exploded view of the distal end of the quick-release handle of FIG. 10A.
Figure 11:
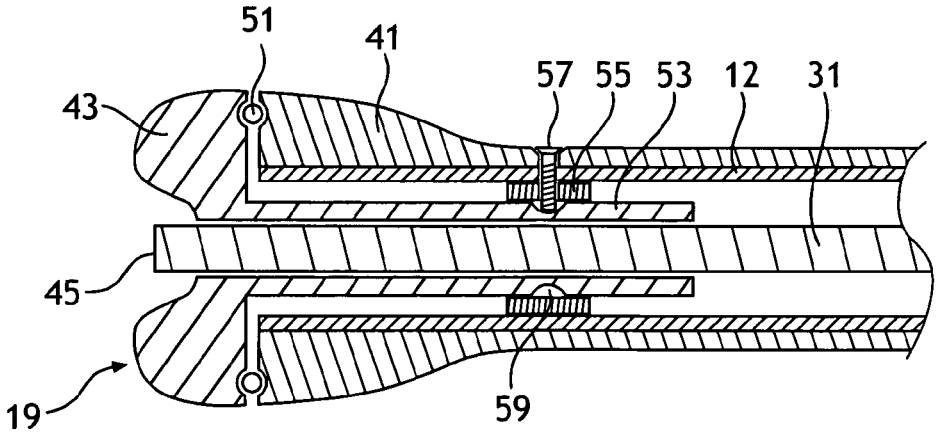
FIG. 11 is a cross-sectional view of the distal end of the quick-release handle of FIG. 10A taken along the line 11-11.

A knob 43 such as shown in FIGS. 10A, 10B and 11, provides the user with a much larger diameter end to the handle 10 compared to traditional sticks. The larger diameter of the knob 43, relative to traditional sticks makes the knob 43 much easier to grasp. By increasing the surface area of the distal end surface 19 of the knob 43, the forces experienced by the user's hand are spread out over a greater surface area than can be achieved by a rounded end of a traditional stick. Such a better distribution of forces result in a reduction in the amount of fatigue the user experience in their hand.

The knob 43 may be formed as a unitary part of the terminus of the grip 41 or it may be an additional part added to the distal end 18 of the shaft 12. The knob 43 shown in FIGS. 10A, 10B and 11 is only intended to be an exemplary shape for such a knob 43; the knob 43 may be any size and shape, symmetrical or asymmetrical, that allows the user to comfortably grasp and utilize the handle 10.

As can be seen in FIGS. 7 and 10A, the shape of the knob 43 is extended to the grip 41 of the distal end 18 of the handle 10. This functional grab area 44 of the knob 43 allows a user to maintain a grip of the knob 43, when the user pushes the handle 10 away from their body. This is particularly useful in mopping when a user will regularly "cast out" a mop and then bring the handle 10 and mop back to themselves.

Additionally, the button actuator 45 is also present at the distal end 18 of the handle 10. As shown in FIGS. 10A and 11, the button actuator 45 is incorporated into the knob 43 and is recessed within the distal end surface 19. As such, the user may grasp the knob 43 during use without unintentionally depressing the button actuator 45 and accidentally releasing the mop head 500. The button actuator 45 shown in FIGS. 10A, 10B, and 11 is merely the terminus of the push rod 31. However, the button actuator 45 may be a separate piece attached or otherwise operably connected to the push rod 31

The knob 43, as shown in FIGS. 10A, 10B and 11, may additionally have the added ability to freely rotate 360-degrees on the terminus of the distal end 18 of the shaft 12. Such a freely-rotating knob 43 would reduce the rubbing and twisting that the user's hand experiences when using traditional sticks. By allowing the knob 43 to freely rotate, the user may maintain a grasp on the knob 43 during regular use of the tool and avoid the fatigue and blisters that often accompanied use of a traditional push broom, mop, or floor duster.

The rotation of the knob 43 may be accomplished with by any type of mechanical bearings, as are well known, that allow the desired 360-degrees of free rotation. By way of non-limiting examples, the rotation may be accomplished with sliding bearings or bushings, rolling-element bearings (such as ball bearings, roller bearings, taper roller bearings), fluid bearings, magnetic bearings, or the like. In the example shown in FIGS. 10A, 10B, and 11, the rotation of the knob 43 is accomplished with a track of ball bearings 51 that are held in place by cooperative recesses in both the end of the grip 41 and in the knob 43. The ball bearings 51 allow the knob 43 to freely-rotate a full 360-degrees about the axis of the shaft 12, on the end of the grip 41.

The assembly of the freely-rotating knob 43 is illustrated in FIGS. 10A, 10B and 11. A shaft sleeve 53 is associated with the knob 43 such that the shaft sleeve 53 fits over the push rod 31 when the knob 43 and associated shaft sleeve 53 are inserted into shaft 12. A knob-connecting collar 55 inserted into the shaft 12 fits around the shaft collar 53. A set screw 57 is inserted from the exterior of the handle 10, through the grip 41, through the shaft 12, and into the knob-connecting collar 55. As such, the set screw 57, holds the knob-connecting collar 55 in place within the interior of the shaft 12. When the knob 43 and associated shaft sleeve 53 are inserted into the shaft 12, the set screw 57 is aligned with a notch 59 circumscribed on the exterior of the shaft sleeve 53. With the set screw 57 in place within the notch 59, the knob 43 is held firmly in place on the terminus of the handle 10 and against the ball bearings 51. As such the knob 43 may freely rotate 360-degrees upon the ball bearings 51, the shaft sleeve 53 is allowed to also freely rotate within the shaft 12, and the knob 43 is kept from being pulled from the end of the handle 10.

Additionally, the shaft sleeve 53 has an interior diameter that allows the push rod 31 to pass through the shaft sleeve 53 such that knob 43 and shaft sleeve 53 may freely rotate about push rod 31. As shown in FIGS. 10A and 11, the button actuator 45 is recessed within the distal end surface 19. When in use, the knob 43 freely rotates about the button actuator 45 and push rod 31 without the risk of the user unintentionally depressing the button actuator 45 or the non-rotating button actuator 45 rubbing on the palm of the user's hand.

Figure 12:
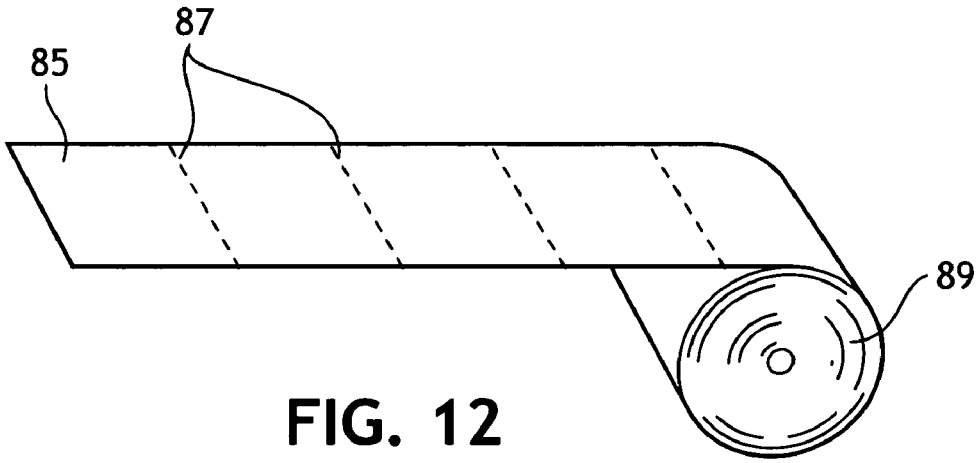
FIG. 12 is a perspective view of a continuous web of selectable-width cleaning substrate in a roll format.

As the mop heads 500 of the present invention include an adjustable-width head, it desired that the disposable cleaning substrate be compatible with such varied widths. One solution is the use of a continuous web of selectable-size cleaning substrate as a part of the system. As shown in FIG. 12, the continuous web of selectable-size substrate 85 may have lines of weakness 87 at regular intervals along the length of the web 85. Such lines of weakness 87 may be perforations, scoring, areas of weakened material, or other similar character that allows a portion of the cleaning substrate to be removed from the continuous web of substrate 85. The regular interval between the lines of weakness 87 would be an interval that would complement the available widths that the mop head 500 is capable of being configured.

For example, the mop head 500 of the present invention may be designed with its central frame section 501, 601, 801 and adjunct frame section to provide the user with available head widths of 12 inches (305 mm), 18 inches (457 mm), 24 inches (610 mm), 36 inches (914 mm), and 48 inches (1.2 m). In such a system, a selectable-size substrate 85 would preferably have lines of weakness 87 at 6-inch (152 mm) intervals. The user would then be able to easily tear off any appropriate length of substrate 85 for the particular width head 500 that they were using.

Figure 13:
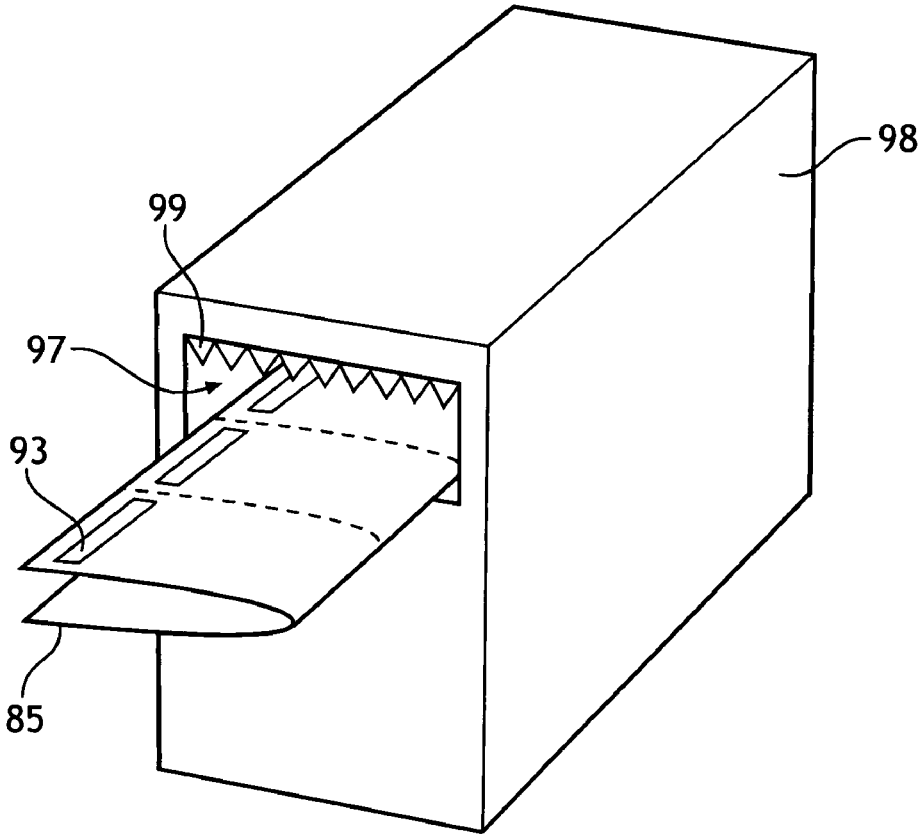
FIG. 13 is a perspective view of a continuous web of selectable-width cleaning substrate and disposed within a container.

Such disposable cleaning substrates may be a single flat sheet as shown in FIG. 12, a folded or two-ply sheet as shown in FIG. 13, or other formats that could be provided as a continuous web and as necessary for the various widths and configurations of a particular mop head 500. As shown in FIG. 13, such substrates may additionally include substrate fasteners 93 that may interact with the particular mop head 500 to attach the substrate to those heads 500.

The selectable-size substrate shown in FIG. 12 is provided in a roll format 89. As such, the roll 89 could be mounted in a roll product dispenser, as are commonly available and widely understood. Such a dispenser could be available on the wall, on a cart, or wherever would be most convenient for the user of the system. Alternatively, the selectable-size substrate 85 may be provided to the user in a container 98, such as shown in FIG. 13. The substrate 85 could be stored and dispensed from the container 98 through a dispensing opening 97 in the container 98. The substrate 85 may be available in the container 98 in any format that is desired. It may be a roll 89, as in FIG. 12, merely piled in the container 98, or may be festooned within the container 98.

Additional functionality could also be added to the container 98. As shown in FIG. 13, the container 98 may have a separator 99 that the user could use to more easily separate the cleaning substrate along the lines of weakness 87. Such containers 98 may also include indicia that would help the user identify the amount or type of substrate contained, instructions on proper use, disposal instructions, or other messages that are desired to be conveyed to the user. Such indicia may be any word(s), numeral(s), line(s), symbol(s), picture(s), color(s) and/or combination(s) thereof, that convey the desired message. Additionally, or alternatively, the container 98 may have additional features such as viewing slots such the user can see the amount of remaining substrate, mounting brackets for mounting the container 98 on a support surface, disposal/recycling features, or other such characteristics that enhance the system and make it easier to use.

It will be appreciated that the foregoing examples and discussion, given for purposes of illustration, are not to be construed as limiting the scope of this invention, which is defined by the following claims and all equivalents thereto.

We claim:

1. A mop head assembly, adapted for use with a handle and a disposable cleaning substrate, the mop head assembly comprising:

a central frame section comprising a front edge, a back edge extending across the width of the central frame section, a pair of opposing ends extending across the depth of the central frame section between the front edge and the back edge, a central portion, and a lower substrate support surface;

a head mount positioned between the opposing ends of the central frame section, the head mount comprising a socket mount configured to releaseably couple the head mount with a mop handle; and at least one adjunct frame section configured to be operably coupled to the central frame section; and a biasing means, wherein the adjunct frame section is configured to move between a stored configuration, wherein the adjunct frame section is stored by the central frame section, and an extended configuration, wherein the adjunct frame section extends from the central frame section to add width to the central frame section and to the lower substrate support surface, wherein the adjunct section comprises a telescoping section contained within the central frame section and configured to be pulled out from the end of the central frame section, and wherein the biasing means is configured to provide a continuous lower substrate support surface at the interface of the central frame section and the adjunct frame section.

2. The assembly of claim 1, wherein more than one adjunct frame section is nested within the central frame section and wherein the more than one adjunct frame section is configured to be pulled out from the end of the central frame section.

3. The mop assembly of claim 1 further comprising:

at least one adjunct frame section telescopically engaged at each of the ends of the central frame section;

a pair of opposing end caps, each coupled with one of the adjunct frame sections; and a telescopic transverse support shaft coupled with the pair of opposing end caps and extending proximate to the back edge of the central and adjunct frame sections, wherein the head mount is coupled with the middle of the telescopic traverse support shaft, and wherein the telescopic traverse support shaft is configured to move between a stored configuration and an extended configuration.

4. The assembly of claim 3, further comprising a quick-release mop handle releaseably engaged with the head mount, wherein the quick-release handle comprises a proximal end proximate to the mop head assembly and a distal end distal to the mop head assembly; a quick-release coupling assembly positioned on the proximate end of the handle, the quick-release coupling assembly configured to releaseably couple the handle with the head mount; and a button actuator positioned on the distal end of the handle, the button actuator operably connected to the quick-release coupling assembly.

5. The assembly of claim 1, further comprising at least one fastener channel associated with the lower substrate support surface of the central frame section, wherein the at least one fastener channel extends from an end of the central frame section, and wherein at least one fastener strip is configured to be inserted, contained, and removed from the fastener channel.

6. The assembly of claim 5, further comprising at least one fastener channel associated with the lower substrate support surface of the adjunct frame section and at least one fastener strip configured to be inserted, contained, and removed from the fastener channel.

7. The assembly of claim 1, further comprising a quick-release mop handle releaseably engaged with the head mount, wherein the quick-release handle comprises a proximal end proximate to the mop head assembly and a distal end distal to the mop head assembly; a quick-release coupling assembly positioned on the proximate end of the handle, the quick-release coupling assembly configured to releaseably couple the handle with the head mount; and a button actuator positioned on the distal end of the handle, the button actuator operably connected to the quick-release coupling assembly.

8. The assembly of claim 1, wherein the lower substrate support surface is convexly curved between the front edge and back edge of the central frame section.

* * * * *

UNITED STATES PATENT AND TRADEMARK OFFICE

CERTIFICATE OF CORRECTION

PATENT NO. : 7,607,191 B2
APPLICATION NO. : 11/458109
DATED : October 27, 2009
INVENTOR(S) : Morris et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 106 days.

Signed and Sealed this

Twelfth Day of October, 2010

David J. Kappos

David J. Kappos
*Director of the United States Patent and Trademark Office*